US005485945A

United States Patent [19]

Linsenbardt et al.

[11] Patent Number: 5,485,945

[45] Date of Patent: Jan. 23, 1996

[54] OPENING APPARATUS HAVING AN ALIGNMENT SYSTEM FOR PRODUCING A CONTINUOUS METAL STRIP FROM A SPLIT-TUBE

[75] Inventors: Thomas L. Linsenbardt, Loman, Mo.; Daniel H. Hickman, Florence, S.C.

[73] Assignee: ABB Power T&D Company Inc., Raleigh, N.C.

[21] Appl. No.: 378,200

[22] Filed: Jan. 25, 1995

Related U.S. Application Data

[60] Division of Ser. No. 121,613, Sep. 15, 1993, Pat. No. 5,406,818, which is a continuation-in-part of Ser. No. 791, 103, Nov. 12, 1991, Pat. No. 5,359,874.

[51] Int. Cl.[6] ..... B65H 23/02

[52] U.S. Cl. ..... 226/10; 226/21

[58] Field of Search ..... 226/10, 15, 18, 226/20, 21, 45; 228/49.6, 147, 151; 198/401; 72/37, 257

[56] References Cited

U.S. PATENT DOCUMENTS

| | | | |
|---|---|---|---|
| 1,423,361 | 7/1922 | Rockwell | 72/256 |
| 1,811,374 | 6/1931 | Watkins | 72/176 |
| 2,133,874 | 10/1938 | Sparks | 72/256 |
| 3,664,561 | 5/1972 | Feiertag | 226/21 |
| 4,564,347 | 1/1986 | Vaughan | 72/262 |
| 4,572,417 | 2/1986 | Joseph et al. | 226/20 |
| 4,823,586 | 4/1989 | Sinha et al. | 72/262 |

*Primary Examiner*—Lowell A. Larson
*Attorney, Agent, or Firm*—Woodcock Washburn Kurtz Mackiewicz & Norris

[57] ABSTRACT

Twin metal billets are fed to dual circumferential grooves formed in a rotating wheel. The billets are advanced first to a wedge-shaped gap which deforms the billets and are then advanced to a die. The die has a die opening with a circumferentially discontinuous, annular cross-section. The metal from each billet merges in the die opening and exits therefrom in the form of a slit tube. The tube is then opened and flattened to form a flat strip by advancing the slit tube over a forming member having a progressively increasing width. As the tube is advanced over the forming member, an alignment system maintaining the tube in a centered position. The alignment system includes a light source disposed within the tube and two arrays of photo-transistors arranged to receive light from the light source, the amount of light sensed by each array being a function of the position of the slit in the tube relative to a desired position. Any difference results in a steering roll which is in contact with the outer surface of the tube being pivoted in a direction which will bring the tube back into alignment.

11 Claims, 16 Drawing Sheets

OPENING APPARATUS HAVING AN ALIGNMENT SYSTEM FOR PRODUCING A CONTINUOUS METAL STRIP FROM A SPLIT-TUBE

CROSS-REFERENCE TO RELATED APPLICATIONS

This is a division, of application Ser. No. 08/121,613, filed Sep. 15, 1993, which in turn, is a continuation-in-part of application of U.S. Ser. No. 07/791,103, filed Nov. 12, 1991 and entitled "Method and Apparatus for Production of Continuous Metal Strip", now U.S. Pat. Nos. 5,406,818 and 5,359,874, respectively.

BACKGROUND OF THE INVENTION

This invention relates to the production of metal strips and, more particularly, to opening apparatus having an alignment system used in the production of metal strips from split tubes. The resultant strips are particularly suitable for use in the coils of power transformers.

Power transformers, such as overhead distribution transformers and pad mounted distribution transformers, generally include coils which are wound from relatively wide strips of aluminum. In order to provide the requisite electrical characteristics for such transformers, it is necessary that the aluminum strips not only have accurate dimensions, but also have other desired characteristics, such as a desired electrical conductivity and 0-temper.

Heretofore, the aluminum strips have been produced by first casting aluminum into ingots and then cold rolling and hot rolling the ingots to form sheets which are then slit to form the strips. In addition, the strips have been subjected to secondary metal treating processes to contour or curve the edges thereof. Contoured edges enable the strips to be insulated with a dielectric in an optimal manner.

While the foregoing processing has produced satisfactory strips, because of the number of steps involved, it is relatively costly. Accordingly, a continuous process minimizing the number of discreet steps is desirable. In this connection, consideration has been given to conventional extrusion processes. However, such conventional extrusion does not permit the continuous processing that is desired in connection with the production of flat metal strips for power transformer coils.

Accordingly, the above-noted parent application provides a new and improved method and apparatus, employing continuous extrusion, to continuously form flat metal strips suitable for producing coils for power transformers. More specifically, in accordance with the invention of the parent application, first and second continuous rod-like billets are fed through first and second circular grooves formed respectively in a rotating wheel. The first and second billets are advanced by the rotating wheel through a passageway formed between the wheel and a stationary shoe. The billets are advanced by the rotating wheel to first and second abutments positioned to enter the first and second grooves, respectively. The abutments block movement of the billets through the passageway, the billets thereby being plastically deformed and forced out of the grooves to an opening in a die positioned adjacent to the wheel. The deformed first and second billets merge within the die opening which has a circumferentially discontinuous, annular cross sectional shape, and exit therefrom in the form of a slit tube. The tube is then advanced to a forming station at which the tube is opened and flattened by bending it outwardly in opposite directions at the slit.

In accordance with an aspect of the invention of the parent application, an elongated forming member and an opposing surface are provided for opening and flattening the tube. The elongated forming member has an entrance end and an exit end. The entrance end has a width equal to or less than the diameter of the tube, the width progressively increasing from the entrance end toward the exit end of the forming member. Preferably, the opposing surface is flat and in a preferred embodiment is a flat moving belt. The tube is advanced over the forming member and against the flat surface such that the forming member opens the tube from the slit outwardly and forms the tube into a substantially flat strip.

It is highly desirable when opening the tube into a flat strip, as described above, that the tube be centered in the opener as it is pulled therethrough. On occasion, the tube will tend to twist as it is being extruded. If it does, or if it is twisted or off-center when it is inserted into the opener, or if for some other reason misalignment occurs while in the opener, the tube will move off to the side and possibly even out of the opener, causing damage to the edges of the tube or resultant flat strip. It is, therefore, important that alignment of the tube with the opener as it is pulled through the opener be maintained.

One way to accomplish this would be to use guide fingers, pads or rollers on the two surfaces and/or edges to maintain alignment. These, however, would be difficult to thread through the opener and other component parts of the system, could damage the tube's surfaces that they make contact with and would also need to be repositioned when the tube circumference or, correspondingly, the width of the strip changes.

SUMMARY OF THE INVENTION

Accordingly, it is an object of the present invention to provide an opener as described above which maintains the tube in a centered position as it is pulled through the opening.

It is a further object to provide apparatus which may be used with or in any system to align a tube in a desired orientation.

The foregoing and other objects are achieved in accordance with the present invention by an alignment system which is responsive to misalignment of the slit in the tube from a desired angular position to rotate the tube to align the slit to the desired position.

In a preferred embodiment, the alignment system includes means within the tube for directing a light radially outward toward an area which encompasses the desired position. Light emanates from the tube if at least part of the slit is within the area, a characteristic of the emanated light being a function of the actual position of the slit relative to the desired position thereof. Respective means are provided for sensing the light emanating from the tube and for selectively rotating the tube. Control means responsive to the sensing means are provided for controlling the operation of the rotating means to rotate the tube to a position in which the slit is at the desired position.

The objects, advantages, and features of the present invention will be better understood from the following detailed description when considered in connection with the appended drawings in which:

BRIEF DESCRIPTION OF THE DRAWINGS

FIGS. 21 and 22 are elevational views and plan views, respectively, partly diagrammatic and with parts removed for the sake of clarity, of an alignment system illustrating certain features of the present invention which may be used to maintain the tube in alignment as it is pulled through either the embodiment of the opening and flattening station of FIG. 14 or the embodiment of FIGS. 16 and 17;

DETAILED DESCRIPTION

Figure 1:
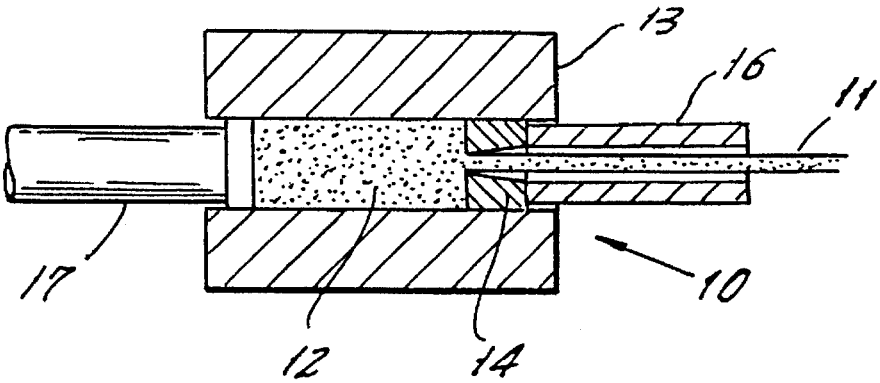
FIG. 1 is a cross-sectional elevation view of a conventional extrusion apparatus.

Referring now to the drawings and, in particular, to FIG. 1, there is shown a conventional extrusion apparatus 10 for extruding a product 11 from a billet 12. The apparatus 10 includes a housing 13, a die 14 and a die stem 16. As is conventional, the billet is driven against the die by a punch 17. As the punch 17 advances, it deforms the billet 12 and extrudes it through the die 14 and die stem 16 to form the product 11. Because of the friction existing between the billet 12 and the housing 13, the force required to commence extrusion limits the length of billets to about five times their diameter. This, therefore, puts a limit on the amount of material that may be extruded at any one time and prevents this type of extrusion from being continuous.

Figure 2:
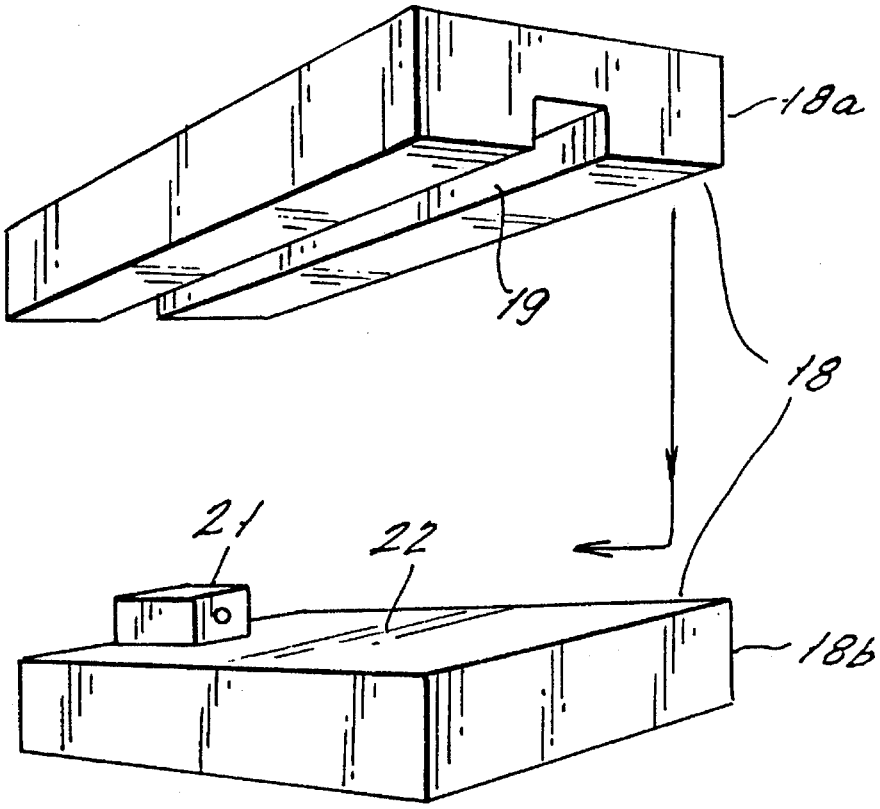
FIG. 2 is a diagrammatic representation of a continuous extrusion process known as the Conform process.

To overcome this problem, the Conform process has been developed in which friction is used to advantage. Referring now to FIG. 2, there is shown diagrammatically an apparatus illustrating the Conform process. As seen in FIG. 2, the conventional housing is replaced by a split housing 18 of rectangular cross section. An upper part 18*a* of the housing 18 has a rectangular cross section groove 19 into which is loaded a tightly fitting rectangular billet (not shown); a lower part 18*b* of the housing holds a die 21 which blocks one end of the groove 21. On movement of the upper part 18*a* of the housing 18 towards the die 21, friction between the billet and the three sides of the groove 21 act to push the billet forwardly against the die. Similarly, the friction between the billet and the top surface 22 of the lower part 18*b* of the housing 18 act to oppose such forward motion. The net force, equivalent to the friction between the billet and two sides of the groove 19, will be directed to driving the billet against the die 21.

Figure 3A:
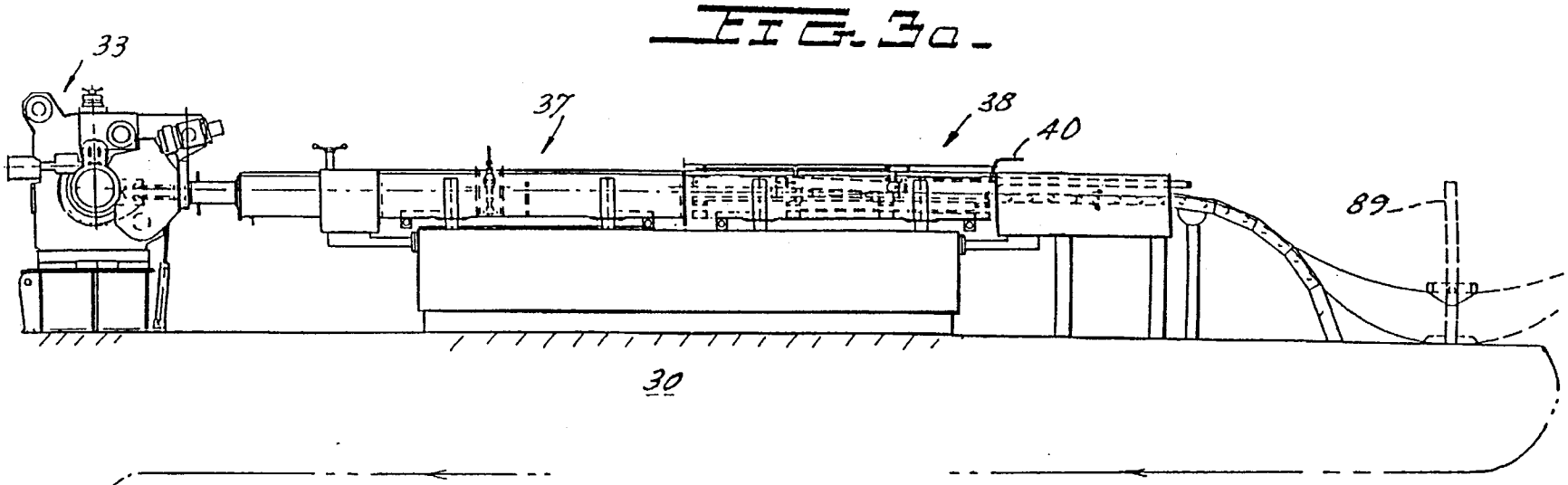
FIG. 3A and FIG. 3B together, with FIG. 3B to the right of FIG. 3A, illustrate apparatus in accordance with the invention for forming flat strips from metal billets.
Figure 3B:
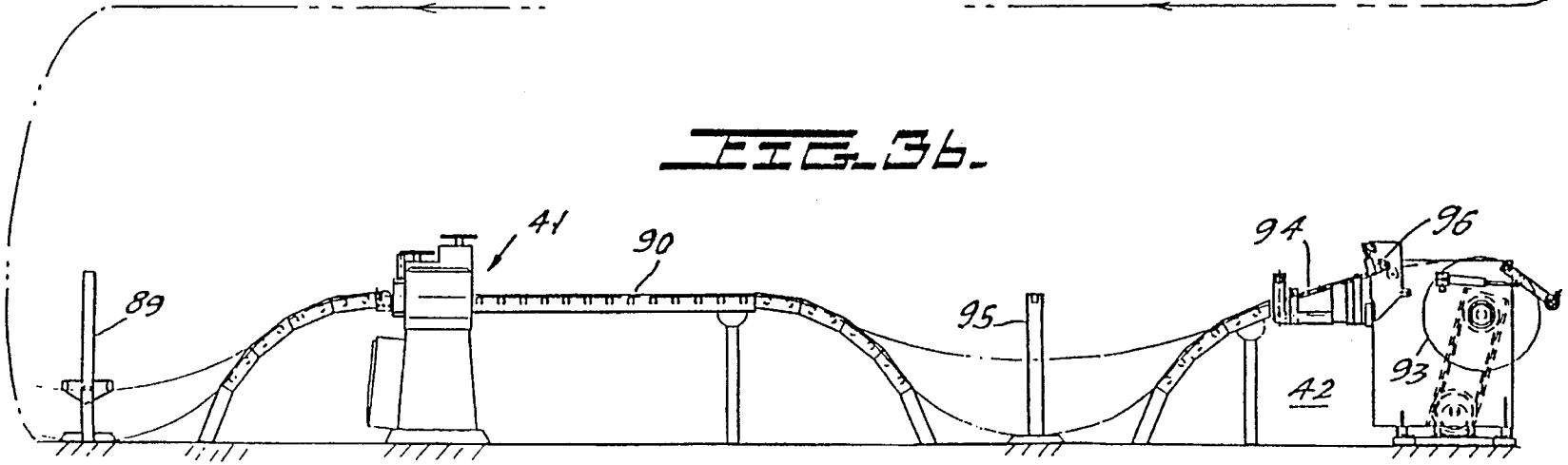
Figure 5:
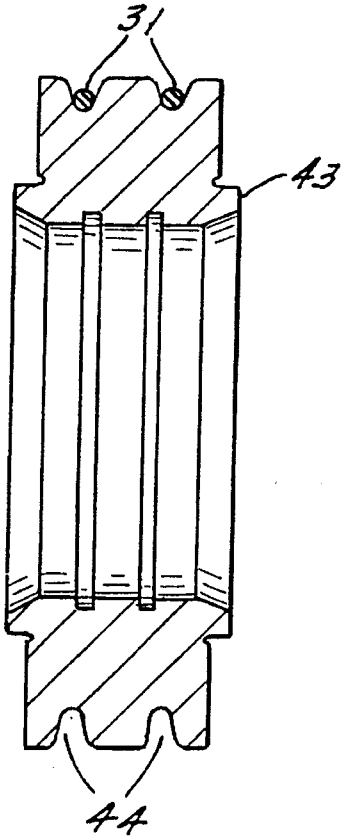
FIG. 5 is a plan view of a wheel used in the Conform extruder of FIG. 4.
Figure 13:
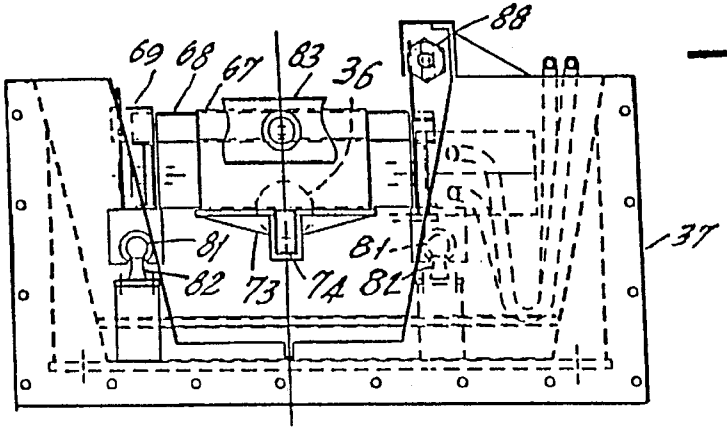
FIG. 13 is an end elevational view, taken along the line 13—13 of FIG. 12.
Figure 12:
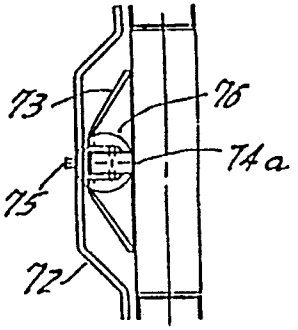
FIG. 12 is an end elevational view, taken along the line 12—12 of FIG. 11.

Turning now to FIGS. 3A and 3B, there is shown apparatus 30 illustrating certain principles of the invention of the parent application in which the Conform process has been adapted to continuously form first and second metal billets 31 (FIG. 5) into a flat strip suitable for forming a power transformer coil 32 (FIG. 13).

Figure 9:
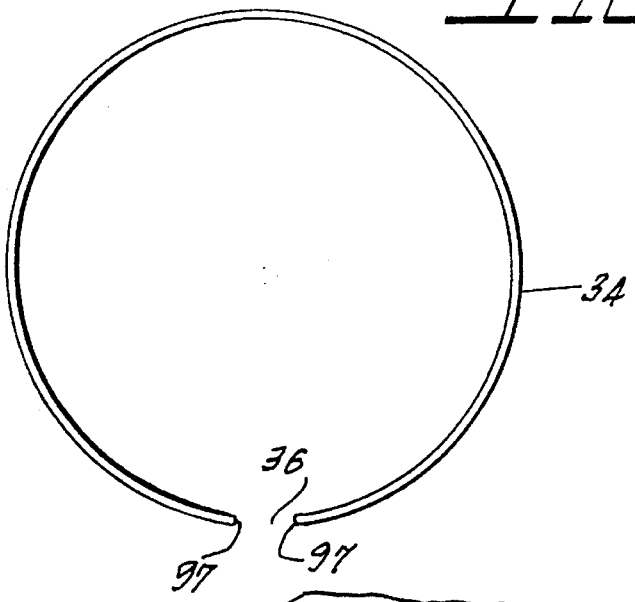
FIG. 9 is a cross-sectional view of the tube after exiting the Conform extruder.
Figure 11:
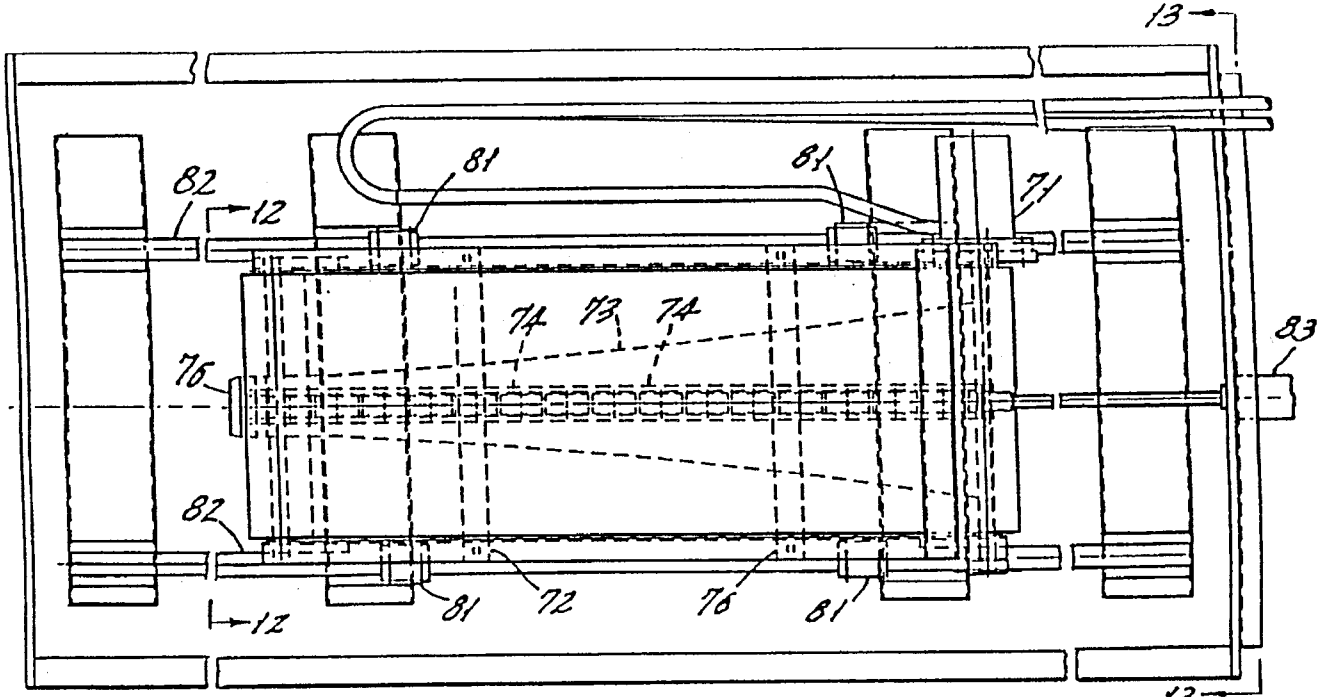

The apparatus 30 includes a Conform extruder 33 which forms the first and second billets 31 into a tube 34 having a slit 36 (FIG. 9). After exiting from the Conform extruder 33 the tube 34 is advanced into a cooling chamber 37 and then to an opening and flattening unit 38 in which the tube is formed into a flat strip 39 (FIG. 11). The flat strip 39 is then advanced to a leveller 41 which functions to complete the flattening of the strip 39 and smooth out any unevenness so that the strip 39 as it exits the leveller 41 is substantially flat. The strip 39 is then wound upon a mandrel 93 by a take-up system 42.

Figure 4:
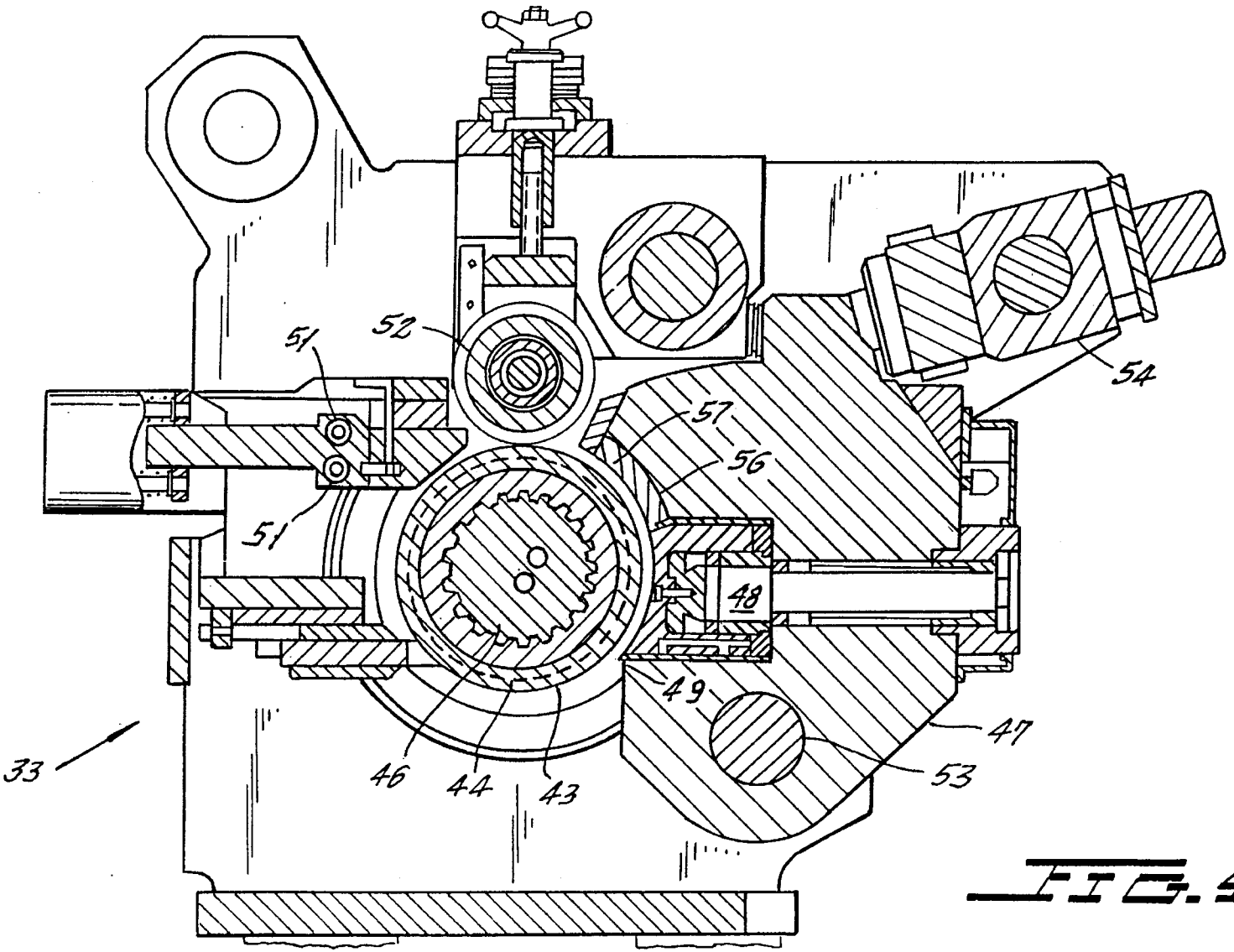
FIG. 4 is a cross-sectional side elevation view of a Conform extruder used in the apparatus of FIGS. 3A and 3B to form the billets into a tube.
Figure 6:
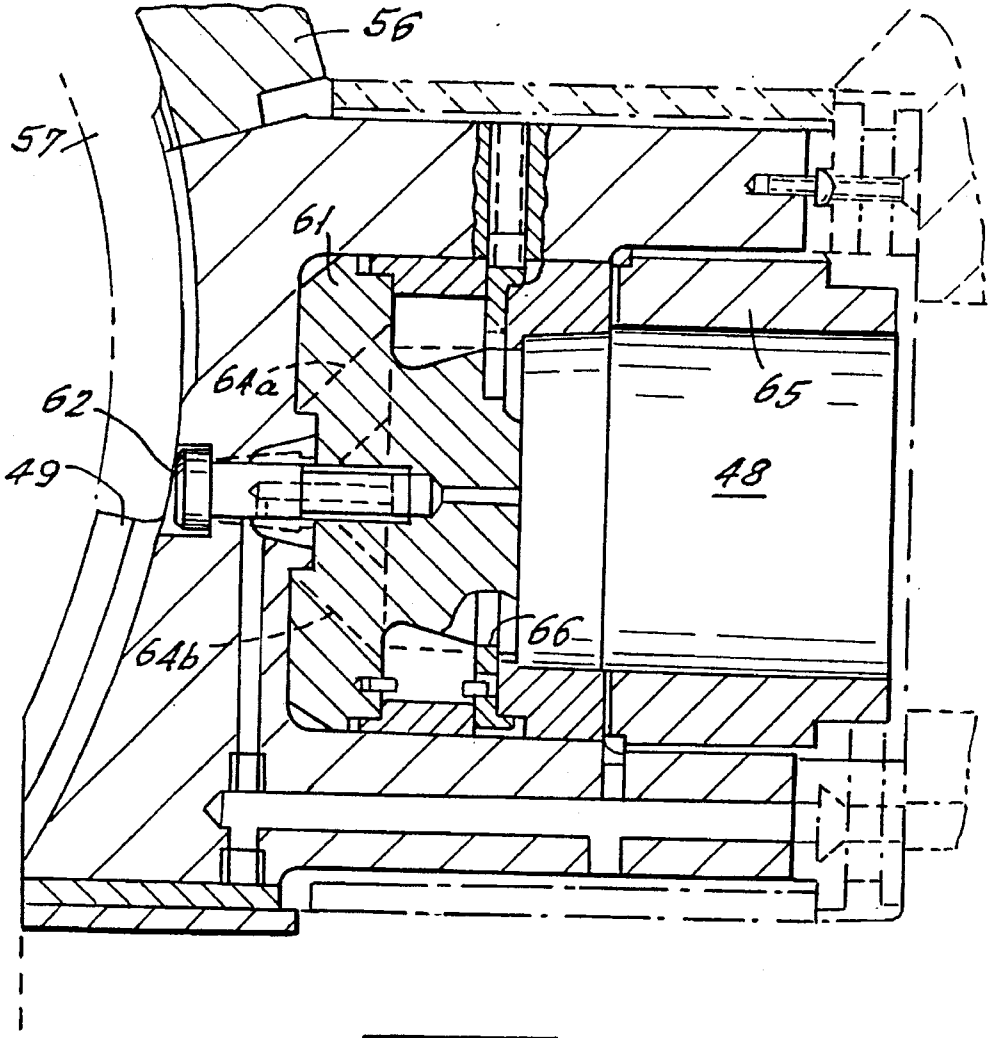
FIG. 6 is a cross-sectional side elevation view of extrusion tooling used in the Conform extruder of FIG. 4.

Referring now to FIG. 4, there is shown a more detailed view of the Conform extruder 33 which may be a conventional continuous Conform extruder available from BWE Ltd., model Twin Groove 350 or 550. The Conform extruder 33 includes a wheel 43 having a pair of circumferential grooves 44 (best seen in FIG. 5) for receiving the first and second billets 31 which advantageously may each be in the form of 0.5 inch diameter aluminum rod. The wheel 43 is mounted for rotation on a splined drive shaft 46 driven by suitable means not shown. The extruder 33 also includes a shoe 47 for holding extrusion tooling 48, the shoe having a pair of abutments 49 (only one of which is shown and is best seen in FIG. 6), which respectively project into the grooves 44 in close proximity to their bottom surfaces. The billets 31 are fed to the wheel 43 through guide rolls 51 and are forced against the Conform wheel 43 by means of a coining roll 52 which is pressure loaded to apply sufficient pressure to the billets 31 as they pass beneath the coining roll 52 so as to facilitate contact with the walls of the grooves 44. The shoe 47 is mounted on a pivot 53 to enable the shoe 47 to be pivoted away from the wheel 43 so that the extrusion tooling 48 may be positioned therein. After the extrusion tooling 48 is positioned, the shoe 47 is pivoted back into its position adjacent the wheel 43. A clamp jack 54 is provided to lock the shoe 47 in this latter position. The shoe 47 also includes an entry block 56 which defines a passageway 57 between the wheel 43 and the inner surface of the entry block 56. The passageway 57 has a wide entrance opening sufficient to accommodate the billets 31 as they initially enter the passageway. The passageway 57 then narrows down at which point frictional forces develop between the billets 31 and the walls of the grooves 44 and between the billets 31 and the inner surface of the entrance block 56. These frictional forces cause the billets to be driven against the abutments 49 and into respective die openings 64 formed in the extrusion tooling 48.

Figure 7:
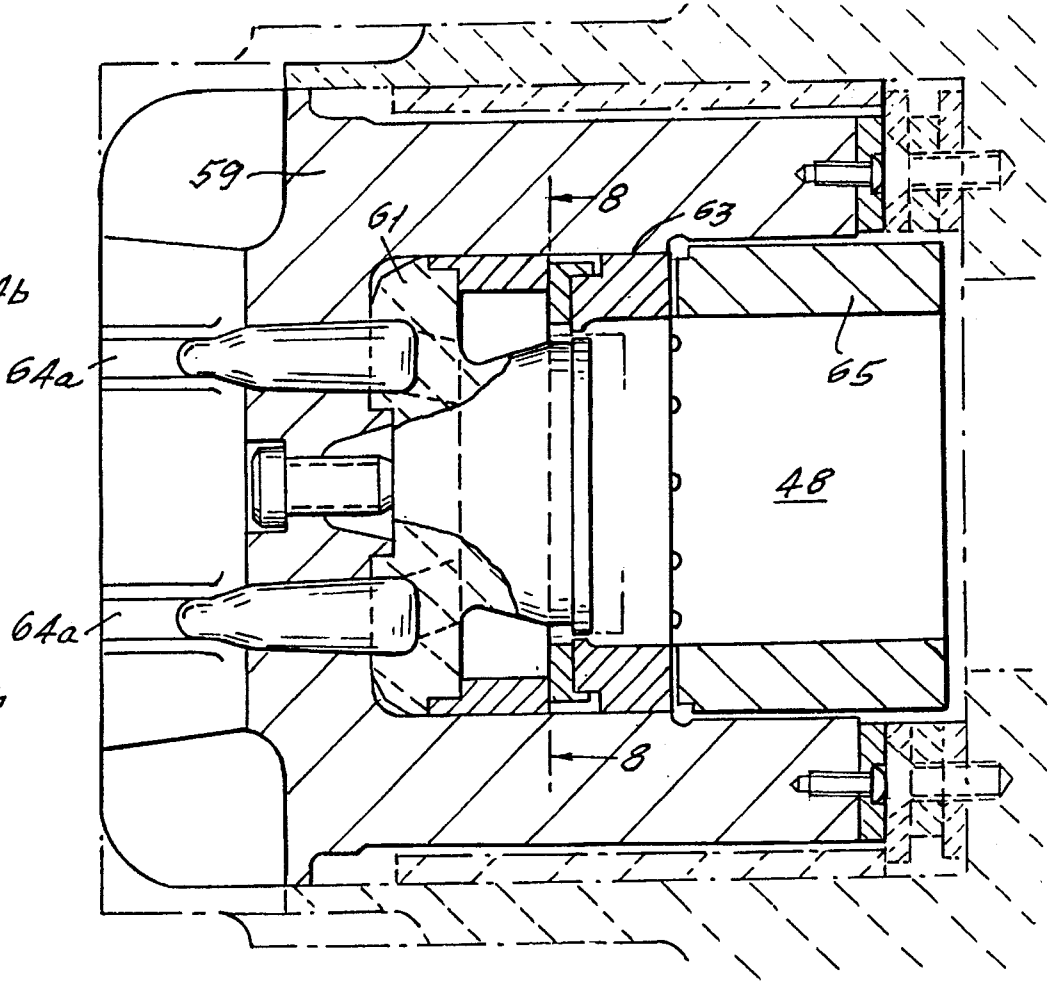
FIG. 7 is a cross-sectional plan view of the extrusion tooling.
Figure 8:
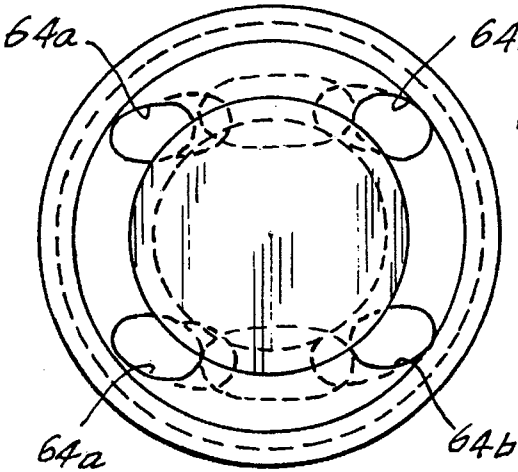
FIG. 8 is a cross-sectional view taken along the lines 8—8 of FIG. 7.
Figure 20:
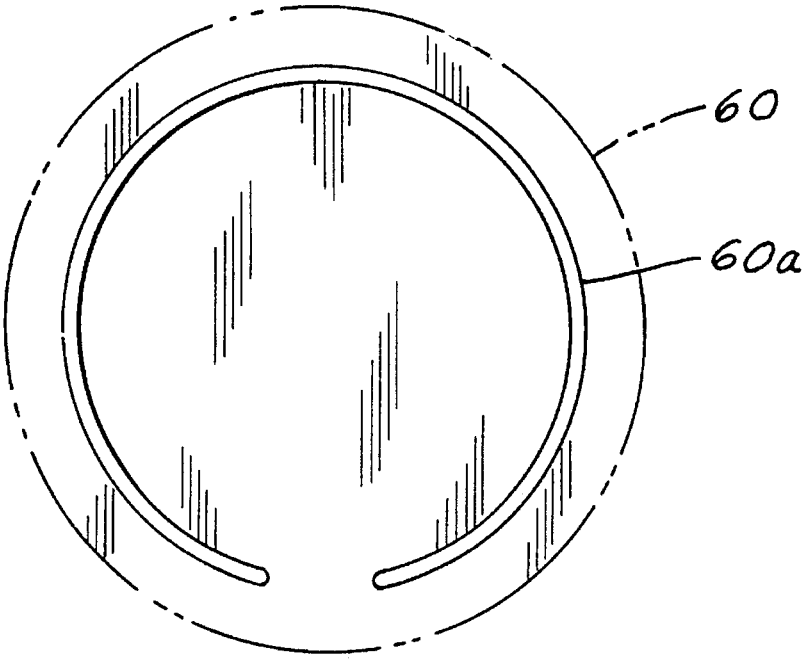
FIG. 20 is a plan view of a plate having a C-shaped slot which may used in the extrusion tooling of the Conform extruder.

Referring to FIGS. 6–8, the extrusion tooling 48 includes a support 59, a mandrel 61 and a die 63. The mandrel 61 is connected to the support by a screw 62 and the die 63 is secured by an internal nut 65. Each die opening 64 branches into two paths, one path 64i adirected upwardly and one path **64*b* downwardly. The deformed billet material flows about the mandrel 61 from each pair of openings 64*a* and 64*b* associated with each billet 31, and is extruded about the mandrel 61 and formed into the tube 34 with the slit 36 (FIG. 9). The slit 36 is formed by closing off the flow of material around a portion of the mandrel 61 by, for example, creating an overlay between the mandrel 61 and a plurality of sizing plates 66. In lieu of using the plurality of sizing plates 66 to close off the opening between the mandrel 61 and the die 63 to form the slit 36, a single flat plate 60 (FIG. 20) having a C-shaped slot 60*a* formed therein by electrical discharge machining, for example, may be employed to perform the same function. The ends of the slot 60*a* are arcuate as shown to cause the edges of the slit 36 and the corresponding edges of the strip 39** to be similarly curved.

The amount of overlay between the mandrel 61 and the sizing plates 66 determining the width of the slit 36 which, in turn, for a tube 34 of a given diameter determines the width of the strip 39. To produce a strip 39 of a different width, the diameter of the tube 34 is kept constant and the width of the slit 36 is adjusted to achieve the new strip width.

The metal from each billet 31 fills its corresponding openings **64*a* and 64*b* equally as the metal proceeds through the openings and exits from the die unit 48. The use of two openings 64*a* and 64*b* for each billet 31 facilitates the passage of the metal around the mandrel 61. The metal exits the die unit 44 in the form of the tube 34 having the slit 36. Referring back to FIG. 3A, after exiting from the Conform extruder 33, the tube 34 passes into the cooling chamber 37 in which a suitable cooling fluid, such as filtered water, is circulated or sprayed by suitable means (not shown) to lower the temperature of the tube 36** from the high temperature of extrusion to a lower temperature suitable for handling of the tube.

The tube 34 then passes into the opening and flattening unit 38 which is located in the exit end of the cooling chamber 37. Placing the opening and flattening unit 38 in the cooling chamber 37 allows the opening and flattening of the tube 34 to be done under water or with a water spray so that the water will act as a lubricant.

Figure 15:
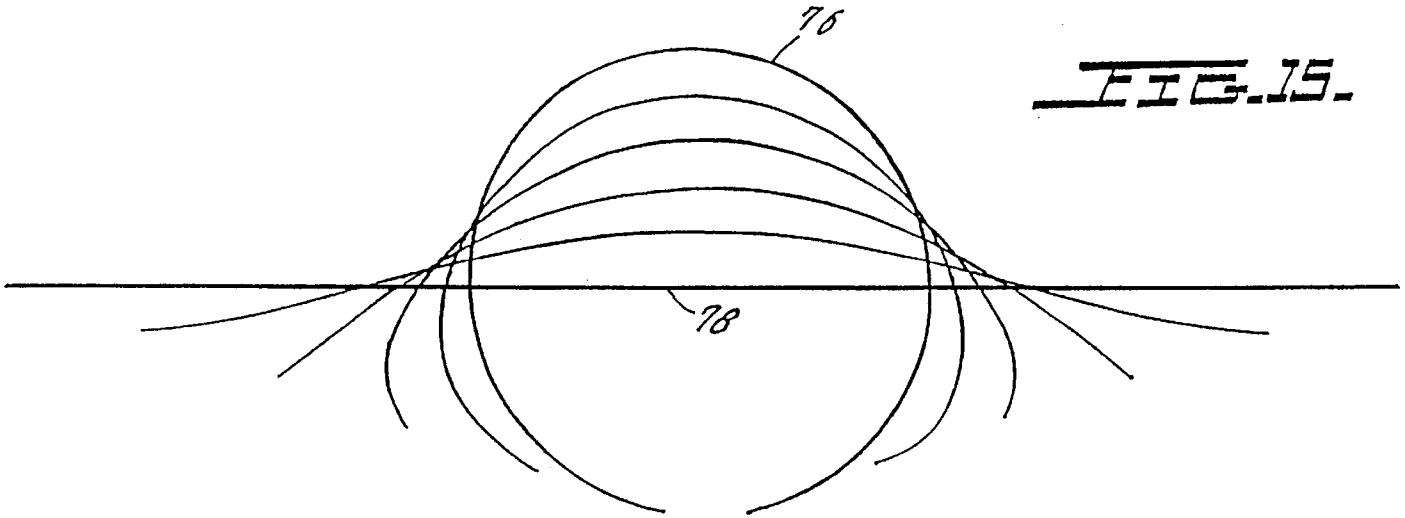
FIG. 15 is a diagrammatic view showing how the cross-section of a shoe used in the opening and flattening station transitions from the entrance end to the exit end of the shoe.

Referring now to FIGS. 10–15, the opening and flattening unit 38 comprises a wide flat belt 67 supported on two sets of pulleys 68 mounted in an aluminum frame 69 and driven by an hydraulic motor 71. Mounted under the frame 69 by brackets 72 is a forming member or shoe 73 which is preferably made of an ultra-high molecular weight plastic, such as ultra-high molecular weight polyethylene, or other low friction material. The shoe 73 is somewhat conically shaped and is split down the center, with a row of pressure rollers 74 mounted along the longitudinal axis thereof. The brackets 72 mount the shoe 73 and rollers 74 to the frame 69 such that the shoe 73 and rollers 74 are pressed upwards against the flat belt 67. The shape of the shoe 73 and its length must be chosen properly so that little if any deformation is produced in the material of tube 34 as the tube transitions from a circular cross section to a flat cross-section during the opening. Preferably the shoe 73 is shaped so that its upper working surface has a contour which transitions as shown in FIG. 15 from circular to flat. More specifically, the entrance end or nose 76 of shoe 73 has a height and width substantially equal to the diameter D of the tube 34, the width of the shoe progressively increasing from the entrance end 76 to the exit end 78 thereof. The height decreases until the cross-section of the shoe 73 at the exit end 78 is flat and is at the longitudinal axis of the shoe which is coaxial with the longitudinal axis of the tube 34. The width increases until it is equal to the circumference of the tube 34.

In operation, the leading end of the split tube 34 is inserted into the opening and flattening unit 38 with the slit 36 at the bottom between the belt 67 and the first pressure roller **74*a*. The belt 67 and the first pressure roller 74 cooperate to grip the leading end of the tube 34 and pull the tube across the shoe 73. The nose 76 has a guide finger 75 which projects into the slit 36 to guide the tube 34 over the shoe 73. As the tube 34 is pulled across the shoe 73, the shoe 73 causes the tube 34 to spread until an almost flat strip 39 leaves the opening and flattening unit 38**.

Figure 10:
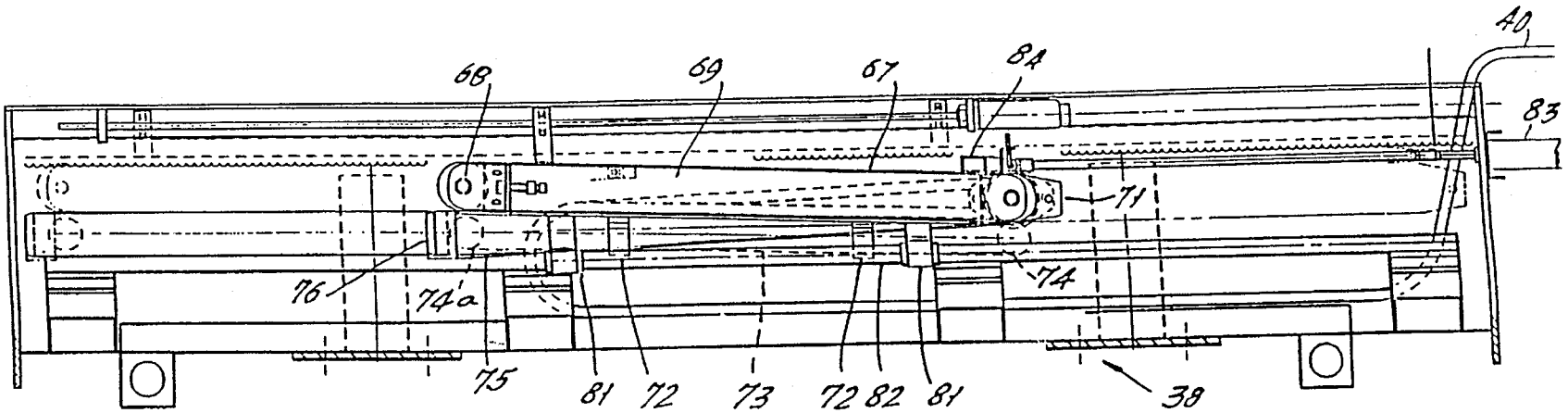
FIGS. 10 and 11 are respectively a side elevational view and a top plan view of a first embodiment of an opening and flattening station for opening and flattening the tube to form the tube into a flat strip.

The opening and flattening unit 38 is arranged for linear movement toward and away from the Conform extruder 33, as shown by the phantom lines in FIG. 10. More specifically, the opening and flattening unit 38 is mounted on linear bearings 81 which, in turn, are mounted on a pair of spaced longitudinally extending rods 82. The capability of the opening and flattening unit 38 to move to and fro enables the unit to accommodate variations in the speed of the tube 34 which are inherent in the extrusion process. While the opening and flattening unit 38 is moving to and fro, an air cylinder 83 connected to a tension bar 84 mounted across the width of the frame 69, applies a force to the belt in the same direction as the extrusion direction. This force, which is applied across the width of the belt by the tension bar 84, acts to keep tension in the tube 36 as constant as possible. Constant tension in the tube 36, in turn, tends to keep the tube straight and the cross-section constant. The air pressure applied to the air cylinder 83 is regulated to accomplish the constant tension.

The speed of the belt 67 must be matched to the speed of the extrusion. This may advantageously be accomplished by an electronic speed controller (not shown) which uses the outputs from a pulse tachometer roller 87 in contact with the tube 34 and a linear transducer 88 mounted along the travel of the opener assembly. The speed controller adjusts the speed of the hydraulic motor 71 to keep the opening and flattening unit 38 centered as much as possible in its travel. As the opening and flattening unit 38 tends to move away from the Conform extruder 33, the speed of the belt 67 will be increased and when it moves toward the Conform extruder its speed will be decreased. The control parameters are selected such that variation in extrusion speed is compensated by to and fro movement of the opening and flattening station 38 about the midpoint of its travel under loading of the tension bar 84.

An alternative embodiment 138 of an opening and flattening unit is shown in FIGS. 16 through 19. Components of the opening and flattening unit 138 are all designated by three digit reference numerals with those major components which are the same as or have the same function as major components of the opening and flattening unit 38 having a 1 as the first digit and having the same last two digits as the reference numerals of the major components of the opening and flattening unit 38; other components of the opening and flattening unit 138 have a three digit reference numeral beginning with 2.

The opening and flattening unit 138 comprises a wide flat belt 167 supported by two sets of pulleys 168 mounted in an aluminum frame 169 and driven by an hydraulic motor 171. Mounted onto the frame 169 by brackets 172 is a shoe 173. The shoe 173 includes a nose 76, guide fingers 175 and a pair of upper spreading members 201, a lower spreading member 202, channel member 203 to which rollers 174 are rotatably mounted and a pair of support plates 204. The support plates 204 are keyed to the channel 203 and the upper spreading members 201 are connected to the support plates by suitable fasteners (not shown). The lower spreading member 202 is connected to the channel member 203 by suitable fasteners (not shown). The brackets 172 mount the channel member 203, and hence the shoe 173, to the frame 169 so that the shoe 173 and rollers 174 are pressed upwards against the flat belt 167. The upper spreading members 201 and the lower spreading member 202 are contoured such that they progressively increase in width from the nose 176 towards the exit end of the opening and flattening station 138. Additionally, both the upper spreading members 201 and the lower spreading member 202 have arcuate cross sections so that the combination approximates the shape of the conical shoe 73 of the first embodiment. Operation of the opening and flattening unit 138 is similar to that of the opening and flattening unit 38. More specifically, the leading end of the tube 34 is inserted into the opening and flattening unit 138 with the slit 36 at the bottom between the belt 167 and the first pressure roller 174. The belt 167 and the first pressure roller 174*a* cooperate to grip the edge of the tube 34 and pull the tube across the shoe 173. As the tube 34 is pulled across the shoe 173, the upper and lower spreading members 201, 202 cause the tube 34 to spread until an almost flat strip 39 leaves the opening and flattening unit 138.

Like the opening and flattening unit 38 of the first embodiment, the opening and flattening unit 138 is arranged for linear movement towards and away from the Conform extruder 33. For this purpose the opening and flattening unit 138 is mounted on linear bearings 181 which, in turn, are mounted on a pair of spaced longitudinally extending rods 182. Control of movement of the opening and flattening unit 138 is accomplished in the same manner as that of the opening and flattening unit 38. A tension bar 184 under the control of an air cylinder 183 is mounted across the width of the frame 169 so as to apply a force to the belt 167 in the same direction as the extrusion direction.

It is important to keep the tube 34 centered in the opener 38 or 138 as the tube is pulled therethrough. On occasion, the tube 34 will tend to twist as it being extruded. If it does, or if it is twisted or off-center when it is inserted into the opener, or if for some other reason misalignment occurs while in the opener, the tube will move off to the side and possibly even out of the opener, with possible damage to the edges of the tube 34 or strip 39.

To maintain alignment of the tube 34 as it proceeds through the opener, an alignment system 300 (FIGS. 21 through 25) may advantageously be used with either the opening and flattening unit 38 or the opening and flattening unit 138.

Figure 23:
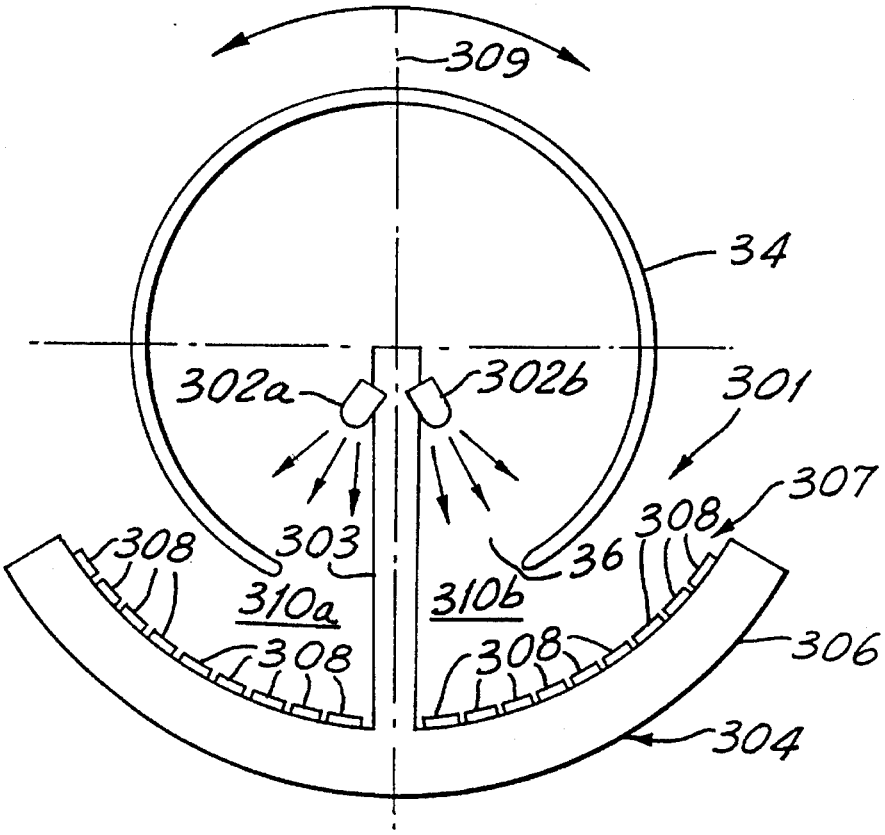
FIG. 23 is a view taken along the lines 23—23 of FIG. 22.
Figure 27:
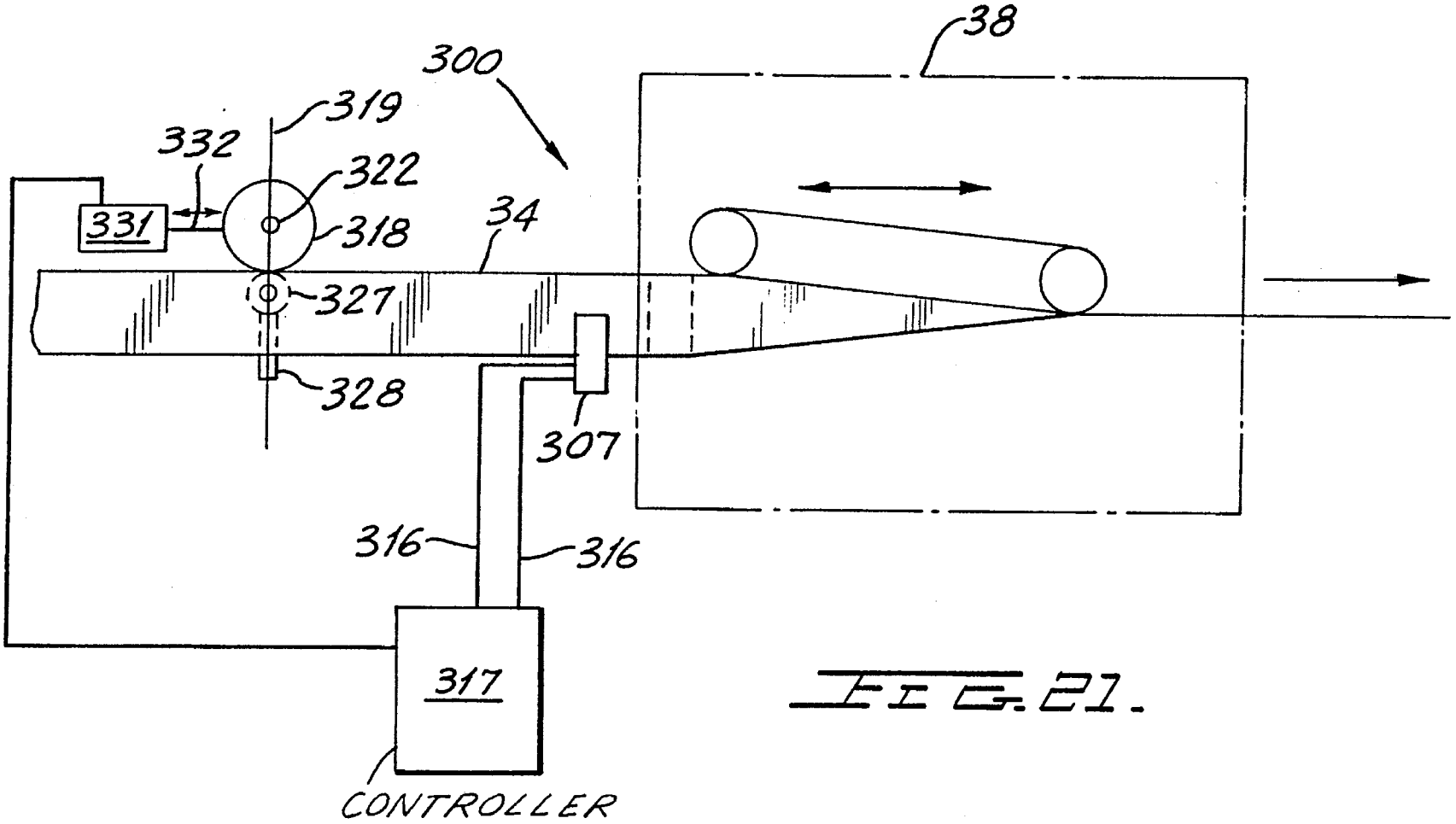
Figure 22:
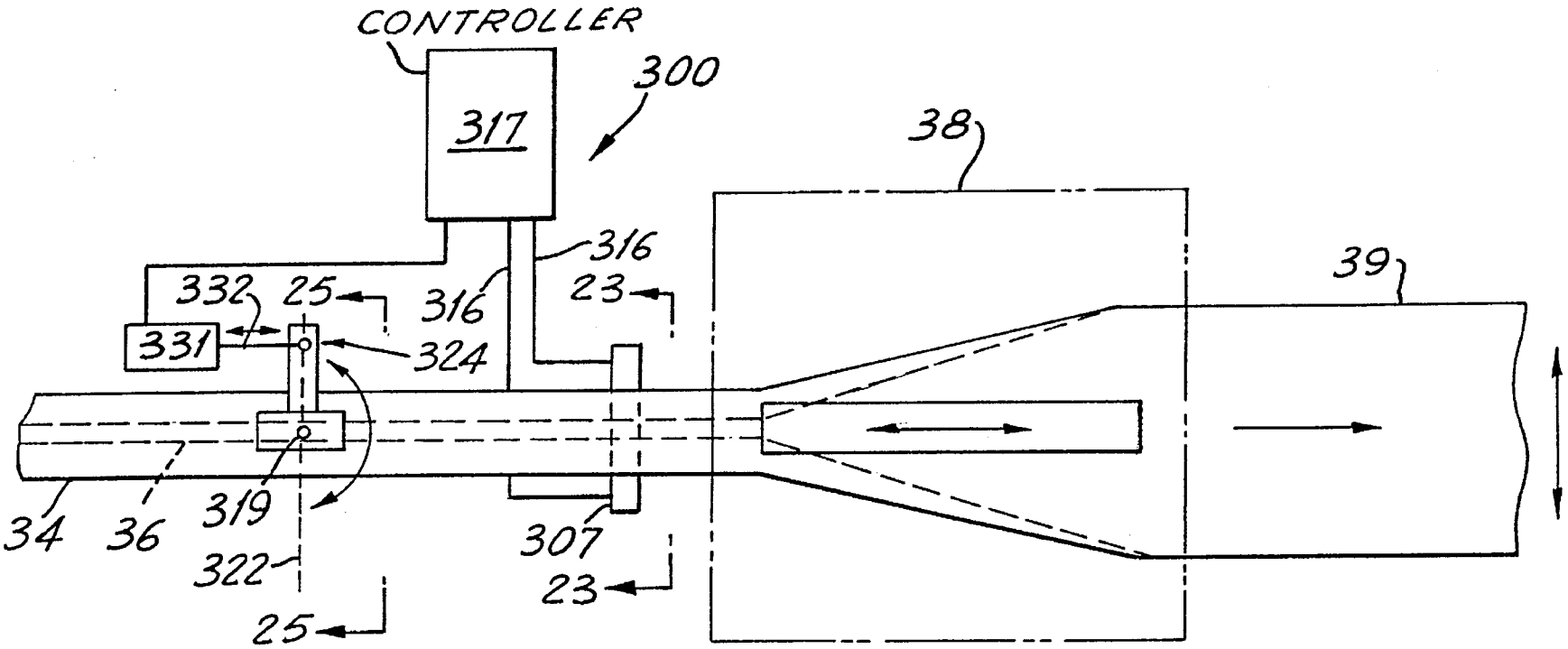

Referring now to FIG. 23, the alignment system 300 includes a misalignment detector 301 mounted under the tube 34 and centered on the desired location of the slit 36. The detector 301 includes a light source in the form of a pair of LEDs 302*a*–302*b* mounted on an upwardly extending leg 303 of a support frame 304 having a circular crosspiece 306 for mounting a light sensing unit 307 in the form of a plurality of photo-transistors 308. The LED's 302*a*–302*b* are mounted on the leg 303 such that their emitted light is directed radially outward toward an area that encompasses the desired position of the slit 36. More specifically, the LED 302*a* is arranged to illuminate an area to the left (as viewed in FIG. 23) of a vertical centerline 309 extending through the leg 303 while the LED 302*b* is arranged to illuminate an area to the right of the vertical centerline.

The photo-transistors 308 are arranged in two arrays, an array 310*a* to the left of the vertical centerline 306 and arranged to receive light from the LED 302*a* and an array 310*b* to the right of the centerline 309 and arranged to receive light from the LED 302*b*. The leg 303 shields the array 310*a* from receiving light from the LED 302*b* and the array 310*b* from receiving light from the LED 302*a*.

The photo-transistors 308, rather than being arranged in a single row, as shown in FIG. 23, may be arranged in two rows with the photo-transistors of one row being staggered with respect to the photo-transistors in the other row. Such staggering fills in any gaps between adjacent photo-transistors, thereby enabling a smoother output voltage from the arrays 310 and 310*b*. Preferably, the width of the beams emitted by the LED's 302*a* and 302*b* should be wide enough to handle a range of widths of the slit 36, while the arrays 310*a* and 310*b* should have sufficiently wide fields of view to cover the same range of slit widths.

The frame 304 may either be fixed in position in advance of the opener 38 or 138 or may be fastened to the opener at its entrance end such that it will move with the opener. In either instance, appropriate means (not shown) are provided for supporting or fastening the frame 304. Each of the photo-transistor arrays 310*a*–310*b* develops a current which is converted to an output voltage which is proportional to the number of photo-transistors which are not blocked by the tube 34 from receiving light from the LEDs 302*a*–302*b*. As will be appreciated, when the slit 36 is at its desired position, the width of the light beam emanating from the tube 34 on the left side of the centerline is equal to that emanating from the tube on the right side. Accordingly, an equal number of photo-transistors 308 will be illuminated in each array, resulting in equal output voltages. If, however, the slit 36 is skewed either to the left or to the right, then one array will receive more light than the other array. For example, if the slit 36 is skewed to the left, as viewed in FIG. 23, then the array 310*a* will receive more light than the array 310b. On the other hand, if the slit 36 is skewed to the right, as viewed in FIG. 23, then the array 310*b* will receive more light than the array 310*a*.

Figure 24:
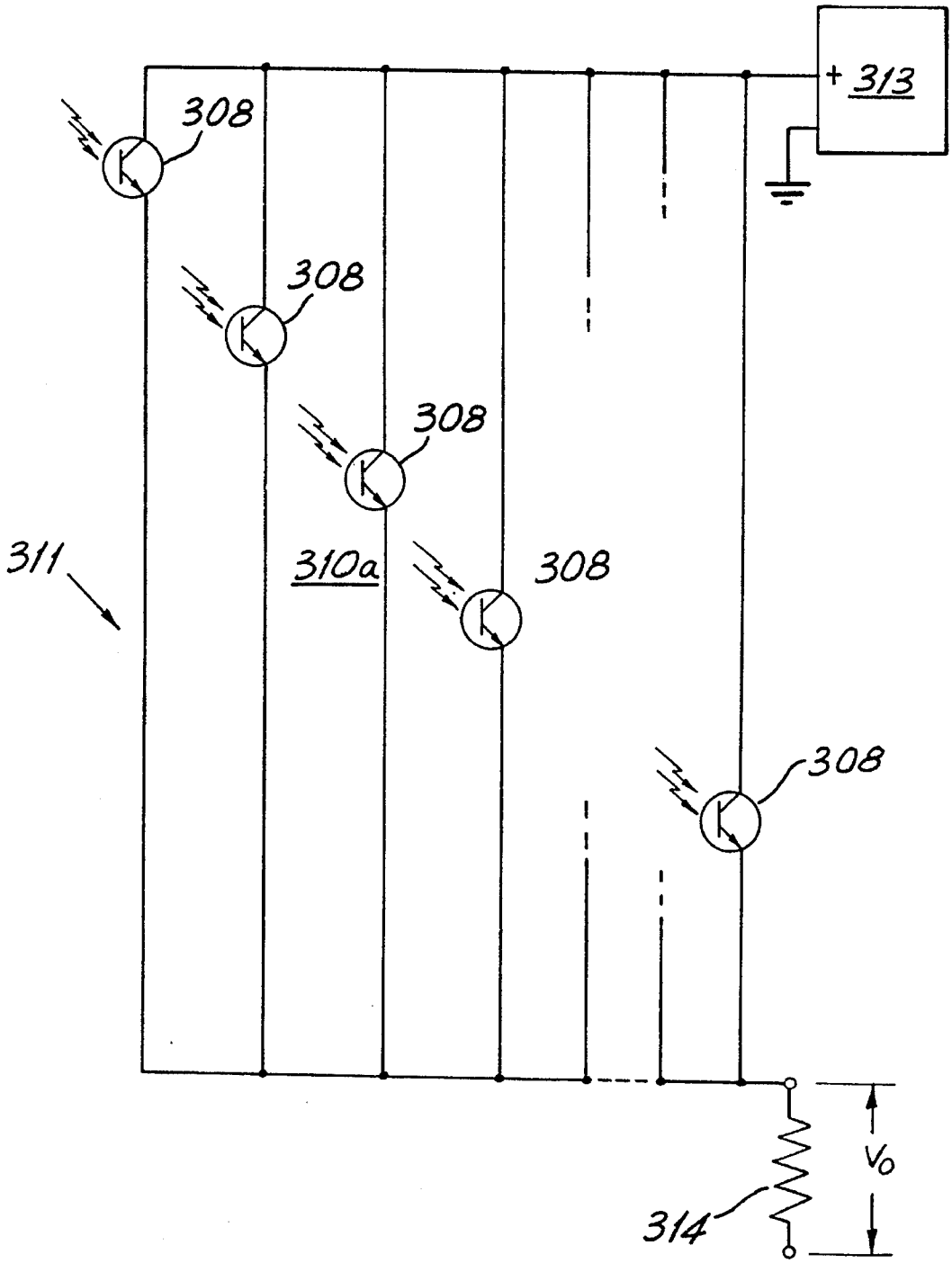
FIG. 24 is a schematic of a circuit used to detect misalignment of the tube.

FIG. 24 is a schematic of a circuit 311 that may be employed for detecting the amount of light received from the photo-transistor array 310*a*. The circuit for the transistor array 310*b* is identical to the circuit 311 and, accordingly, only the circuit 311 will be shown and described. In the circuit 311, the photo-transistors 308 are arranged in a parallel branch circuit 312 connected at one end to a positive DC voltage source 313 and at the other end to a resistor 314. The output voltage of the array 310*a* is the voltage across the resistor 314. The current produced in the parallel branch 312 is proportional to the number of photo-transistors 308 which are illuminated. Accordingly, the current in the branch is at a maximum when all of the photo-transistors are illuminated. The output voltage of the array 310*a*, i.e., the voltage across the resistor 314, in this instance, will therefore be at a maximum.

Turning back to FIGS. 21 and 22, the output signals from the arrays 310*a*–310*b* are transmitted via leads 316—316 to a controller 317 which, in response to an imbalance in the signals, causes a steering roll 318 to be pivoted about a vertical axis 319 (as viewed in FIG. 21) which passes through the centerline of the tube 34 and the opener 38 (or 138). The steering roll 318, which is also mounted for rotation about a horizontal axis 321, is positioned against the top surface of the tube 34.

Figure 25:
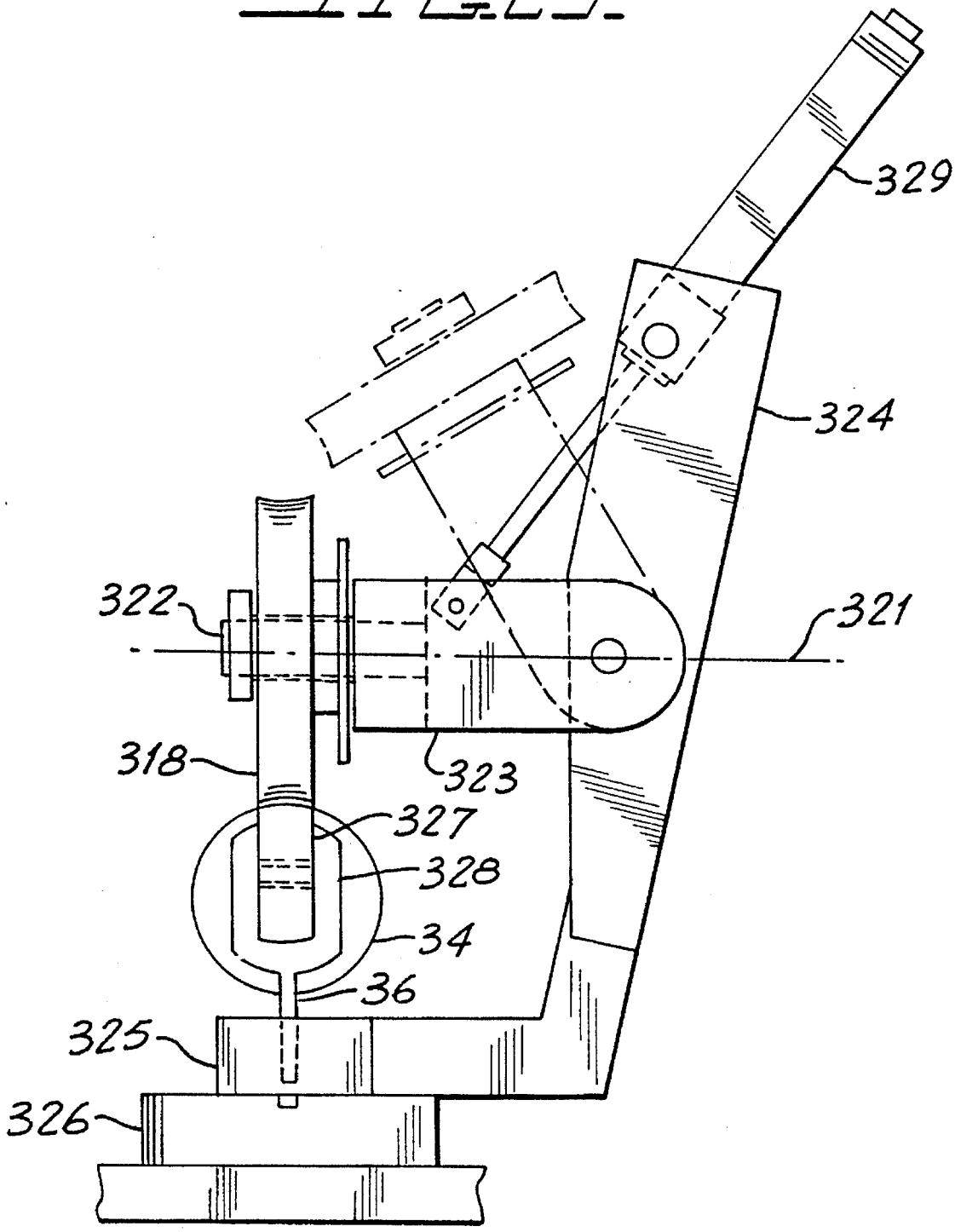
FIG. 25 is a view taken along the lines 25—25 of FIG. 22.

Referring now to FIG. 25, to enable rotation and vertical pivoting of the steering roll 318, the steering roll 318 is mounted on a horizontally extending shaft 322 which is journaled in a horizontally extending bracket 323 connected to a vertically extending arm 324. The arm 324, in turn, is connected at its lower end to a platform 325 which is journaled in a lower support member 326 for pivoting motion about the vertical axis 319. A rotatable support roll 327 is positioned within the tube in contact with the inner surface of the tube 34 directly beneath the steering roll 318. The support roll 327 is supported on the platform 325 by a bracket 328 so that it pivots with the steering roll 318.

Advantageously, the bracket 323 may be pivotably connected to the arm 324 to enable the bracket 323 and the steering roll 318 to be pivoted out of the path of the tube 34 when the tube is being threaded through the system. Suitable means, such as an air cylinder 329, may be provided to effect the pivoting.

Returning back to FIGS. 21 and 22, the steering roll support arm 324 is pivoted about the vertical axis 319 by a linear actuator 331 which has one end fixed and has a shaft 332 movable either to the left or to the right (as viewed in FIGS. 21 and 22) connected to the arm 324. Movement to the right causes the steering roll 318 to pivot about the vertical axis 319 in a clockwise direction (as viewed in FIG. 22), whereas movement to the left causes the steering roll 318 to pivot in a counterclockwise direction. In turn, clockwise movement of the steering roll 318 causes the tube 34 to rotate counterclockwise (as viewed in FIG. 23) while, conversely, counter-clockwise movement of the steering roll causes the tube to rotate clockwise. The actuator 331 is controlled by the controller 317 which, in turn, is responsive to the difference in the amount of light sensed by each of the photo-transistor arrays 310*a*, 310*b*. The alignment system 300, thus, functions to counteract any tendency of the tube 34 to move from its center position and thereby prevents any damage to the edges of the tube 34 or the resultant strip 39. Advantageously, to stabilize the system, the position of the activator shaft 332 may be fedback from the actuator to the controller 317. The actuator 331 may be a MM-1 7073 Linear Actuator and the controller 317 may be part of the ACCUGUIDE II Electronic Web Guide System both available from Accuweb Inc. of Madison, Wis.

In lieu of optically sensing the position of the slit 36 itself, the position of the two edges of the strip 39 after opening may be sensed to determine whether the slit 36 and the tube 34 are centered. In this instance, rather than using light sensing units having broad fields of view, light sensing units having narrow fields would be employed, the light sensing units being positioned at the edges of the strip 39.

Figure 14:
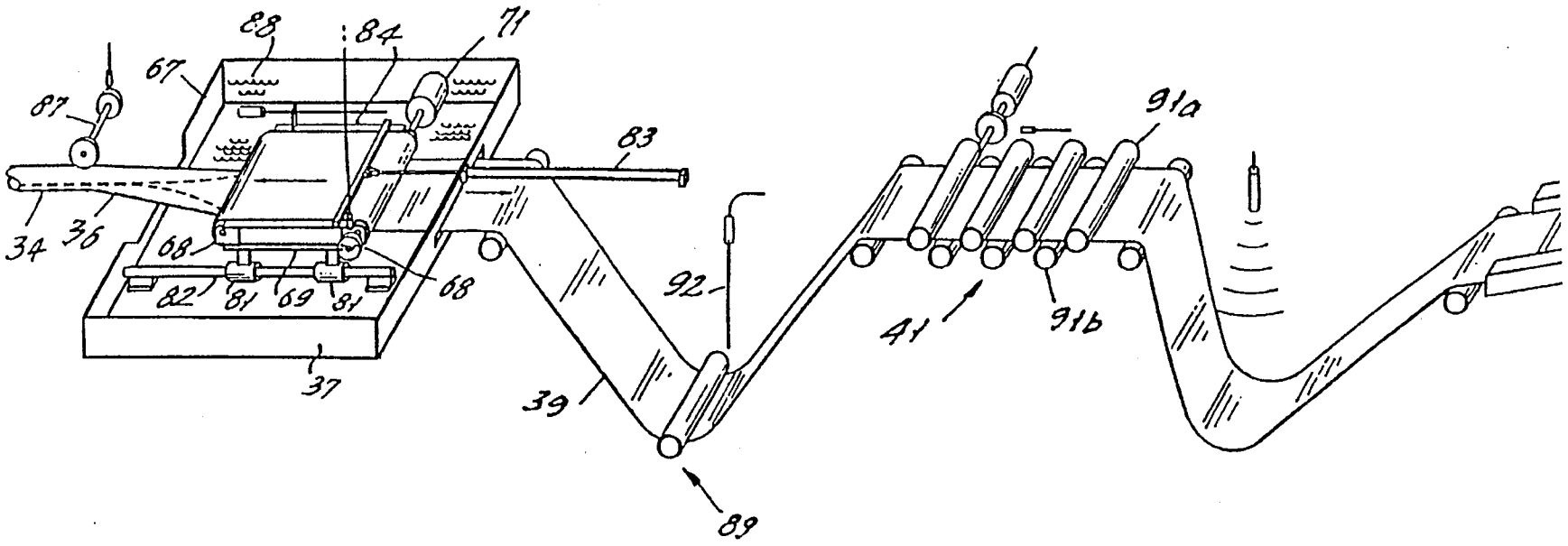
FIG. 14 is a diagrammatic view of the first embodiment of the opening and flattening station and a leveller used in the apparatus of FIGS. 3A and 3B.
Figure 16:
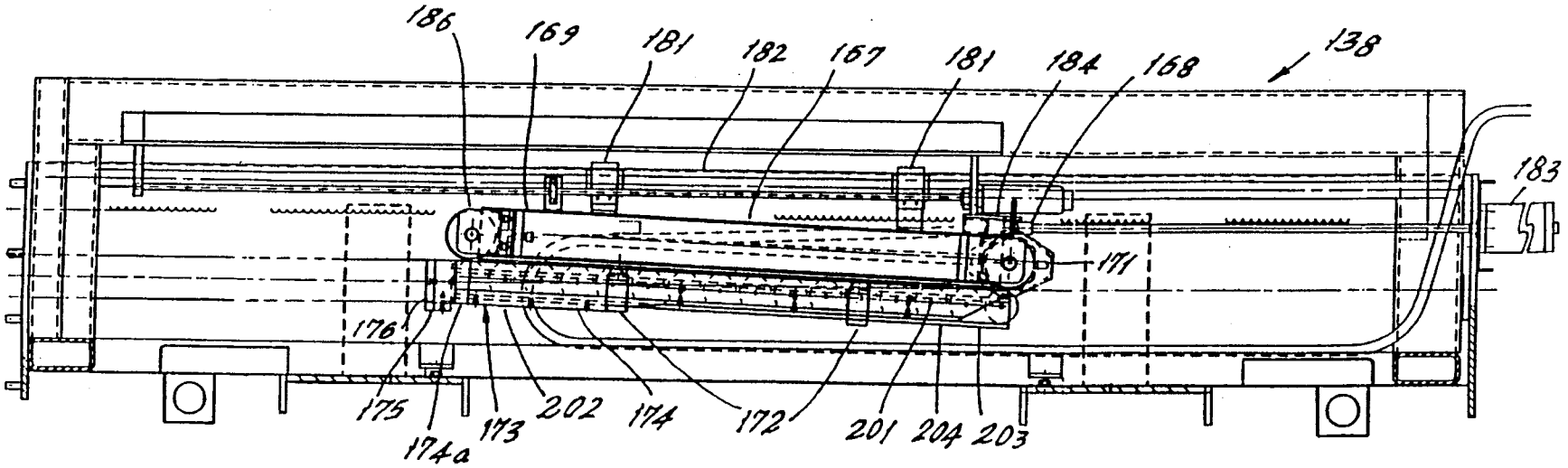
FIGS. 16 and 17 are respectively a side elevational view and a top plan view of an alternative embodiment of an opening and flattening station.
Figure 17:
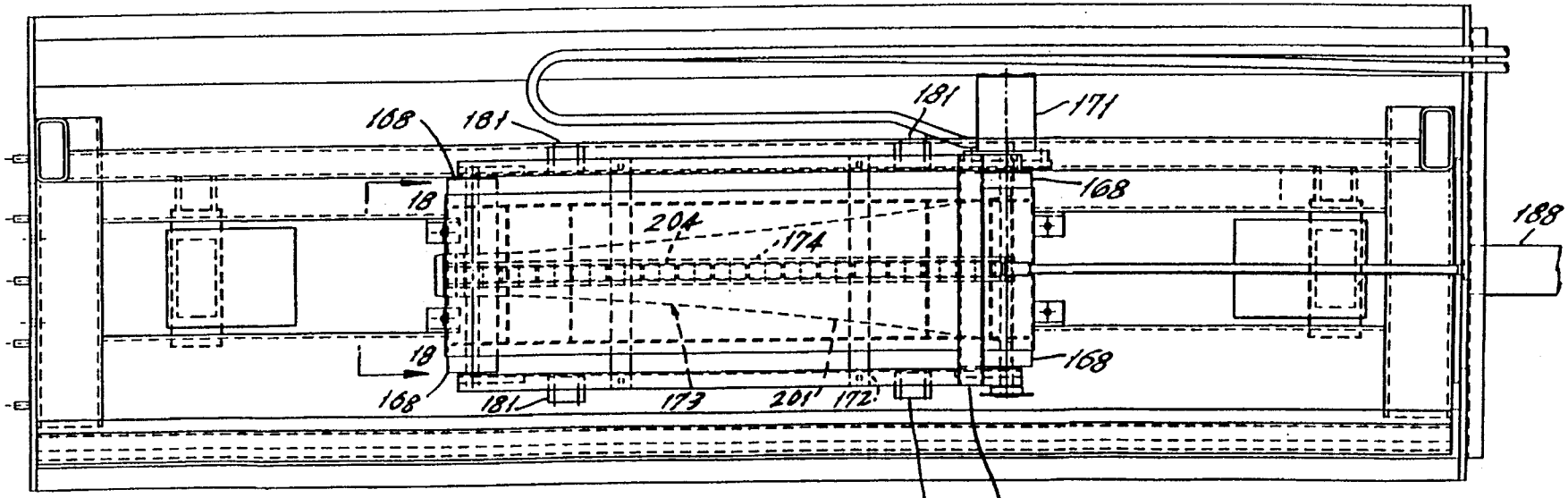
Figure 18:
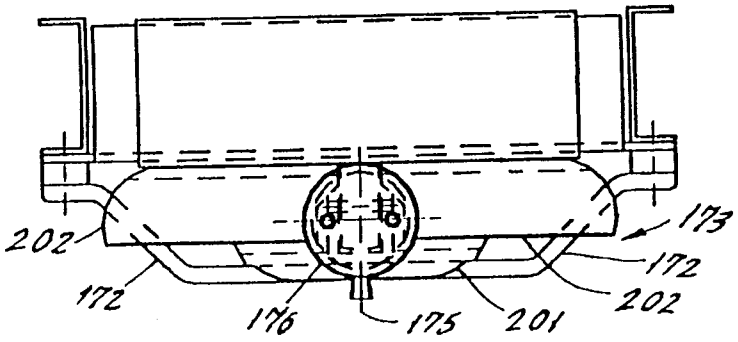
FIG. 18 is an end, elevational view, taken along the line 18—18 of FIG. 16.

When the strip 39 leaves the opening and flattening unit 38 (or the opening and flattening unit 138) it may not be completely flat, but may have some curvature or "crossbow." As best seen in FIG. 14, to remove this curvature, the strip 39 is advanced to a leveller 41 which may be a commercially available 19 roll leveller available from Bruderer Machinery, Inc. The leveller 41 may include 9 rolls 91*a* above the horizontal (only some of which are shown) and 10 rolls 91*b* below (only some of which are shown). As is conventional, the upper rollers 91*a* are both longitudinally and laterally tiltable to remove camber or bend from the strip 39. Additionally, the rolls 91*a* and 91*b* are movable toward one another to increase or decrease their mesh as appropriate to eliminate any waviness of the strip 39. Other levellers having bending rollers may also be used and, indeed, such bending rollers may be particularly efficacious in removing waviness from the strip 39.

The leveller 41 is driven by a variable speed drive system including a variable speed motor and speed controller (not shown) so that its speed matches that of the rest of the line. A dancer assembly 89 (FIG. 3B) located between the opening and flattening unit 38 and the leveller 41 provides downward force on the strip 39 to help overcome curvature or crossbow in the strip and to keep the strip in a catenary loop. Suitable means, such as a magnetostrictive linear transducer 92 are provided to monitor the height of the catenary loop.

Referring back to FIG. 3B, after leaving the leveller 41, the strip 39 is coiled by the take-up system 42 including the mandrel 93. The take-up system 42 also includes edge guides 94 for guiding the strip 39 and tensioning pinch rolls 96 for tensioning the strip 39 during coiling to ensure tight, straight edged coils.

Additionally the apparatus may also advantageously include a conveyor 90 for inspection of the strip 39, a sensor 95 for measuring the height of the catenary loop between the leveller 41 and the take-up system 42, means (not shown) for initial threading of the billets 31 into the Conform extruder 33 and means (not shown) for gripping, cutting off and guiding the leading end of the tube 34 from the Conform extruder 33 into the opening and flattening unit 38. Suitable means (not shown) may also be provided for guiding the strip across the catenary loops during initial threading of the strip 39.

A significant aspect of the present invention is that the balanced flow of metal through the extrusion tooling 48 resulting from the twin groove feed of two billets 31 enables very straight edges 97 of the slit 36. That is, the edges 97 are essentially parallel to the longitudinal axis of the tube 34. This, in turn, enables a flat strip 39 having corresponding straight edges 97. Additionally, the strip 39 is formed with the edges 97 being contoured or curved without the secondary metal treatment necessary in the prior art.

Additionally, keeping the diameter of the tube constant while varying the width of the slit to vary the width of the strip, allows use of the same production line (with only the extrusion tooling 48 changing) to produce strips 39 of different widths and thicknesses.

Unexpectedly, the electrical conductivity and 0-temper of the aluminum material is maintained during the process so that the electrical conductivity and 0-temper of the strip 39 is the same as that of the billets 31. This is unexpected because extrusion performed with prior art processes usually induces increased hardness and decreased electrical conductivity.

Figure 19:
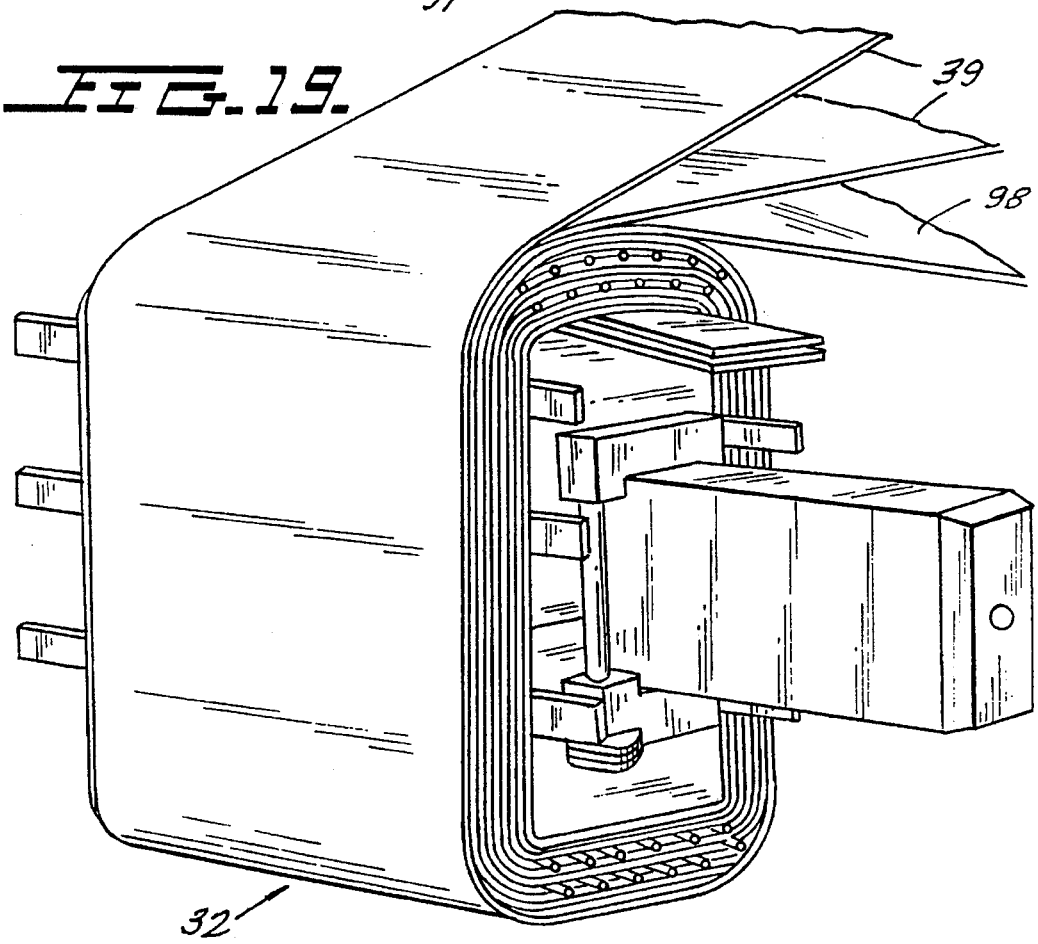
FIG. 19 is a perspective view of a power transformer coil being wound.

Referring now to FIG. 19, there is shown a power transformer coil 32 being wound. The coil 32 is continuously wound from the flattened strip 39. During winding, dielectric insulation 98 is wound between two layers of the strip 39. Because of the contoured or curved edges 97, more reliable transformers 32 are possible. This is because any sharp edges on the strip 39 would concentrate the electrical field stress and create a point from which electrical corona can initiate insulation failure. Burrs which project above (or below) the surface plane of the strip 39 can cut through the insulation 98 during transformer service and result in shorting between turns with consequent transformer failure.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. Apparatus for aligning a tube having an opening in the periphery thereof such that the opening is at a desired angular position, which comprises:

means within the tube for directing light radially outward towards an area encompassing the desired position of the opening, light emanating from the tube if at least part of the opening is within the area, a characteristic of the emanated light being a function of the actual position of the opening relative to the desired position thereof;

means for sensing the light emanating from the tube;

means selectively operatable for rotating the tube; and means responsive to the light sensing means for controlling the operation of the rotating means to rotate the tube into a position in which the opening is at the desired orientation.

2. Apparatus as defined in claim 1, wherein the sensing means includes a plurality of photo-transistors arranged to receive light from the light directing means.

3. Apparatus as defined in claim 2, wherein the light directing means includes first and second LEDs.

4. Apparatus as defined in claim 3, wherein the photo-transistors are arranged in first and second arrays, each array having an equal number of photo-transistors.

5. Apparatus as defined in claim 4, wherein the photo-transistors in the first array are arranged to receive light from the first LED and the photo-transistors of the second array are arranged to receive light from the second LED, the number of photo-transistors receiving light in the first array being equal to the number of photo-transistors receiving light in the second array when the opening is at the desired position thereof.

6. Apparatus as defined in claim 5, wherein the means for rotating includes a steering roll in contact with the top surface of the tube, the steering roll being rotatable about a first axis parallel and orthogonal to the longitudinal axis of the tube and selectively pivotable about a second axis orthogonal to both the first axis and the longitudinal axis of the tube to thereby cause rotation of the tube.

7. Apparatus as defined in claim 6, wherein the rotating means further includes means for pivoting the steering roll about the second axis.

8. Apparatus as defined in claim 7, wherein the control means is responsive to a difference in the number of photo-transistors in each array receiving light to cause the pivoting means to pivot the steering roll in a direction such as to cause the tube to twist about its longitudinal axis to a point at which the number of photo-transistors in each array receiving light is equal.

9. Apparatus for aligning a horizontally disposed tube having an opening in the periphery thereof such that the opening is at a desired angular position, which comprises:

first and second light sources disposed within the tube on opposite sides of a first vertical axis orthogonal to the longitudinal axis of the tube, the light sources being arranged to illuminate respective areas on opposite sides of the first vertical axis, the amount of light passing through the tube at each area being a function of the actual position of the opening relative to the desired position;

first and second arrays of light sensing devices arranged respectively to receive light from the first and second light sources, the arrays being disposed on a common circular arc with respect to the light sources;

a rotatable steering roll in contact with the surface of the tube, the steering roll being pivotable about a second vertical axis passing through the longitudinal axis of the tube;

means selectively operable for pivoting the steering roll about the second vertical axis; and control means responsive to the difference in the amount of light sensed by the light sensing devices to cause the pivoting means to pivot the steering roll in a direction such as to cause the tube to twist about its longitudinal axis to a point at which the amount of light sensed by each array is equal.

10. Apparatus as defined in claim 9, wherein the first and second light sources are LEDs.

11. Apparatus as defined in claim 10, wherein the light sensing devices are photo-transistors and each array has an equal number of photo-transistors.

* * * * *